US005134916A

United States Patent [19]

Klopfer

[11] Patent Number: 5,134,916

[45] Date of Patent: Aug. 4, 1992

[54] BLADE ADJUSTING MECHANISM FOR A PAPER CUTTING APPARATUS

[75] Inventor: Michael Klopfer, Neuffen, Fed. Rep. of Germany

[73] Assignee: Womako Maschinenkonstruktionen GmbH, Nürtingen, Fed. Rep. of Germany

[21] Appl. No.: 713,396

[22] Filed: Jun. 10, 1991

[30] Foreign Application Priority Data

Jul. 11, 1990 [DE] Fed. Rep. of Germany ..... 4022053

[51] Int. Cl.[5] ..... B26D 7/26; B26D 1/09

[52] U.S. Cl. ..... 83/640; 83/618; 83/694; 83/700

[58] Field of Search ..... 83/700, 640, 694, 641, 83/618, 620, 599, 598

[56] References Cited

U.S. PATENT DOCUMENTS

| | | | |
|---|---|---|---|
| 4,392,402 | 7/1983 | Rann | 83/345 |
| 4,485,710 | 12/1984 | Schlisio et al. | 83/700 X |
| 4,494,428 | 1/1985 | Malof | 83/641 |
| 4,932,301 | 6/1990 | Buck | 83/640 |

FOREIGN PATENT DOCUMENTS

| | | | |
|---|---|---|---|
| 2451195 | 5/1976 | Fed. Rep. of Germany | 83/620 |

*Primary Examiner*—Douglas D. Watts
*Assistant Examiner*—Clark F. Dexter
*Attorney, Agent, or Firm*—Peter K. Kontler

[57] ABSTRACT

A paper cutting apparatus with several closely adjacent severing units wherein each unit includes a stationary counterknife and a mobile knife which cooperates with the respective counterknife to sever a stack of paper sheets between them. The mobile knives have holders which are connected to a common reciprocating member, and elongated blades which are bolted to the respective holders. The positions of cutting edges of the blades relative to the corresponding counterknives are adjustable by threaded bolts which are accessible at the end faces of the holders and can transmit motion to discrete blade-displacing elements by way of discrete wedges. The displacing elements are recessed into those side faces of the holders which are adjacent the respective blades.

16 Claims, 2 Drawing Sheets

BLADE ADJUSTING MECHANISM FOR A PAPER CUTTING APPARATUS

BACKGROUND OF THE INVENTION

The invention relates to cutting or severing apparatus in general, and more particularly to improvements in apparatus for cutting stacks of sheets or discrete sheets of paper or the like. Still more particularly, the invention relates to improvements in cutting or severing apparatus of the type having one or more severing units each of which includes a mobile knife and a stationary knife or counterknife.

The position of the cutting edge of one knife relative to the other knife of a severing unit for paper sheets or the like must be adjusted from time to time. As a rule, the adjusting mechanism includes displacing elements in the form of bolts or wedges which are installed in a holder for the blade of the knife and are movable to thereby change the position of the cutting edge of the blade. Reference may be had, for example, to U.S. Pat. No. 4,392,402 granted Jul. 12, 1983 to Rann. This patent describes an apparatus for severing running webs of paper or the like. The apparatus has a set of counterknives which orbit at one side of the path for the running web and a set of knives with adjustable blades which orbit at the other side of the path to cooperate with the orbiting counterknives in order to sever the running web transversely of the direction of longitudinal movement of the web. The adjustable blades are mounted on a common rotary holder and their positions relative to the common holder (and hence relative to the associated counterknives) can be changed by wedges which are accessible at the periphery of the common holder.

The just described apparatus is quite satisfactory for the severing of a single running web or of several overlapping running webs because the adjusting wedges are accessible at the periphery of the rotating holder for the knife blades. However, the situation is different if several cutting or severing units are placed side-by-side in close proximity to each other, e.g., to simultaneously sever a single sheet or several overlapping sheets of paper or the like. Adjusting mechanisms for the blades of such closely adjacent severing units are not readily accessible so that each unit wherein the blade necessitates adjustment must be detached from the reciprocating mechanism for the mobile knives of the severing units before the adjusting mechanism for the blade is accessible for manipulation in order to change the position of the cutting edge of the blade with reference to the blade holder. All this takes up much time and can cause considerable losses in the output of a production line for steno pads, exercise pads and/or other stationery products.

Cutting apparatus with several parallel severing units are often utilized in production lines wherein stacks of relatively large paper sheets are severed at a plurality of locations to convert the stacks into discrete pads or like stationery products wherein the sheets are held together by helical binders, by strips of adhesive or in any other suitable way. Dismantling of the severing apparatus for the sole purpose of adjusting the cutting edge of the blade in a single severing unit would entail huge losses in the output of such production lines.

OBJECTS OF THE INVENTION

An object of the invention is to provide a severing apparatus for paper sheets or the like wherein the position or positions of the cutting edge or edges of one or more blades relative to their holders can be adjusted in a simple and time-saving manner even if the blades of two or more severing units are immediately or closely adjacent each other.

Another object of the invention is to provide a novel and improved adjusting mechanism for the cutting edges of blades in severing apparatus employing two or more closely adjacent sheet severing units.

A further object of the invention is to provide a novel and improved mechanism for adjusting the position of a blade relative to its holder in a severing unit wherein only the end faces of the holder are accessible when the severing unit is ready for use.

An additional object of the invention is to provide a novel and improved holder for use in the above outlined severing apparatus.

Still another object of the invention is to provide a simple, compact and inexpensive blade adjusting mechanism which can be installed in existing types of sheet severing apparatus as a superior substitute for heretofore known adjusting mechanisms.

A further object of the invention is to provide an adjusting mechanism which can be reached and manipulated without necessitating even partial dismantling of the severing apparatus.

Another object of the invention is to provide an adjusting mechanism which renders it possible to place two or more discrete severing units into immediate or very close proximity to each other without adversely affecting the accessibility of the adjusting mechanism.

A further object of the invention is to provide a novel and improved method of installing the adjusting mechanism in the holder for the blade of a mobile knife in a paper sheet cutting apparatus.

An additional object of the invention is to provide a production line for stationery products which embodies one or more adjusting mechanisms of the above outlined character.

SUMMARY OF THE INVENTION

The invention is embodied in an apparatus for severing sheet-like materials (e.g., stacks of paper sheets). The improved apparatus comprises at least one severing unit including a first knife and a second knife, and means for moving one of the knives relative to the other knife whereby the knives sever one or more sheets which are placed between them while the knives are spaced apart from each other. The first knife comprises a blade having an elongated cutting edge and a surface extending along the cutting edge, a holder having an elongated side face adjacent the surface of the blade and at least one end face at one end of the side face, means (e.g., bolts remote from the cutting edge) for connecting the blade to the holder, and means for adjusting the blade relative to the holder, namely for adjusting the location of the cutting edge relative to the second knife (e.g., in order to compensate for wear). The adjusting means comprises a plurality of displacing elements which are recessed into the side face and are movable transversely of and against the surface of the blade (preferably between the cutting edge and the connecting means), a moving element for each of the displacing elements, and devices for transmitting motion between the moving elements and the respective displacing elements. The moving elements are accessible at the at least one end face of the holder and are movable in the holder in substantial parallelism with the cutting edge of the blade.

The one knife is preferably the first knife of the at least one severing unit, and the second knife of such unit is preferably a stationary counterknife.

The moving elements can include or constitute pressure transmitting bolts having axes which are at least substantially parallel to the cutting edge of the blade. Such moving elements are preferably provided with external threads and are rotatable in tapped bores or holes of the holder; the tapped bores extend inwardly from the at least one end face of the holder and communicate with discrete holes or bores for the corresponding displacing elements. The bores or holes for the displacing elements extend at right angles to the surface of the blade and hence at right angles to the side face of the holder. Each motion transmitting device can include a wedge which is operative to move the respective displacing element in its hole or bore in response to movement of the corresponding moving element in its hole or bore. Each wedge has a first surface which is inclined relative to the surface of the blade, and each displacing element has a second surface which is complementary to and abuts the surface of the respective wedge.

The displacing and moving elements are or can be disposed in a common plane, e.g., in a substantially horizontal plane which is at least substantially normal to the surface of the blade and to the side face of the holder.

The holder preferably includes a second end face at the other end of the elongated side face, and the adjusting means preferably further comprises at least one additional displacing element which is recessed into the side face of the holder and is movable transversely of and against the surface of the blade, an additional moving element which is accessible at the second end face of the holder and is movable in the holder in substantial parallelism with the cutting edge, and an additional device for transmitting motion from the additional moving element to the additional displacing element. The side face of the holder includes a first half which is adjacent the at least one end face and a second half which is adjacent the second end face. The at least one additional displacing element is recessed into the second half and the displacing elements which receive motion from moving elements that are accessible at the at least one end face of the holder are recessed into the first half of the side face. The arrangement is preferably such that each moving element at the at least one end face and the associated motion transmitting device and displacing element are mirror images of a moving element which is accessible at the second end face and of the associated motion transmitting device and displacing element.

The apparatus preferably further comprises at least one additional severing unit having a first knife and a second knife. One knife of the at least one additional severing unit is connected to and is movable by the moving means for the one knife of the at least one severing unit. The severing units are preferably closely or immediately adjacent each other. The cutting edge of the blade of the first knife of the at least one severing unit is preferably parallel to the cutting edge of the blade of the one knife of the at least one additional severing unit.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
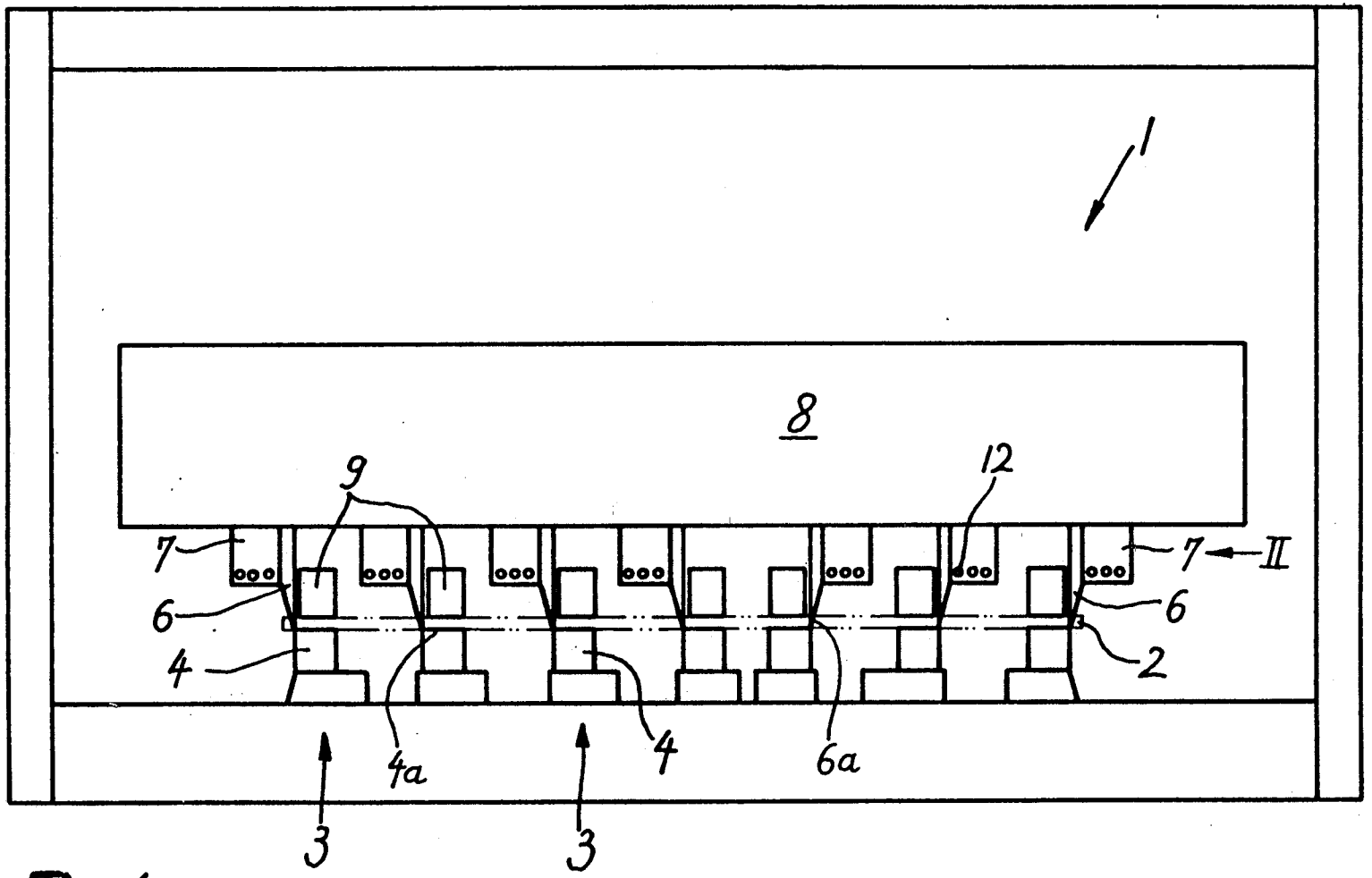
FIG. 1 is a schematic side elevational view of a severing apparatus with a plurality of severing units each of which embodies one form of the invention.

The severing apparatus 1 of FIG. 1 can be used in a production line for writing pads, exercise pads, steno pads and analogous stationery products. The apparatus 1 is designed to simultaneously sever a stack of overlapping sheets 2 into a plurality of smaller sections in the form of strips or the like extending at right angles to the plane of FIG. 1. To this end, the apparatus 1 comprises a plurality of rather closely adjacent parallel severing units 3 each having a mobile first knife 6, 7 and a stationary second knife or counterknife 4 beneath the respective mobile knife. The mobile knives have elongated parallel holders 7 which are affixed to or form part of a common moving member 8 serving to move the holders 7 up and down away from and toward the respective counterknives 4. A sheet 2 or a stack of sheets 2 is introduced between the stationary counterknives 4 and the lifted elongated blades 6 of the mobile knives before the holders 7 are caused to descend whereby the cutting edges 6a of the blades 6 cooperate with the cutting edges 4a of the counterknives 4 to sever the sheet or sheets 2. The means for moving the member 8 up and down in the frame of the severing apparatus 1 can comprise one or more fluid-operated cylinder and piston assemblies or the like, not shown. FIG. 1 further shows hold-down devices 9 which are mounted on the member 8 and cooperate with the adjacent counterknives 4 to prevent shifting of the sheet or sheets 2 in the course of a severing operation.

Figure 2:
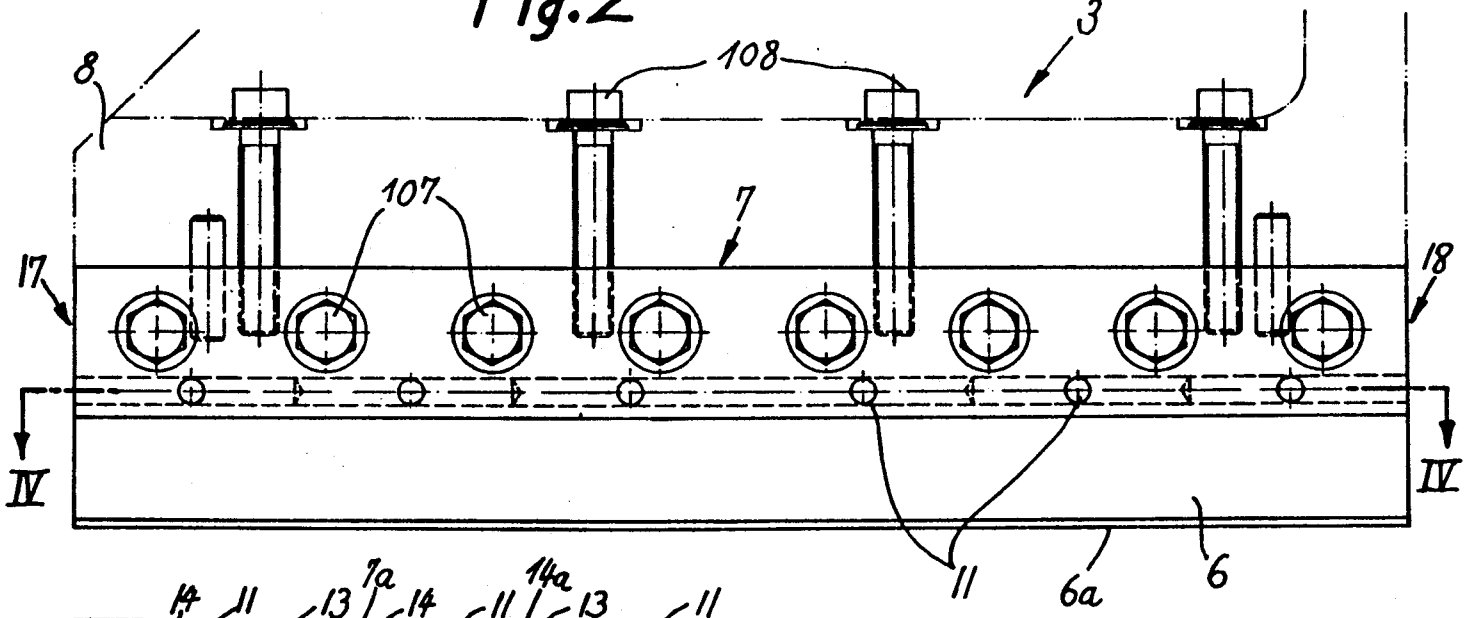
FIG. 2 is a side elevational view of one of the severing units, substantially as seen in the direction of arrow II in FIG. 1.
Figure 4:
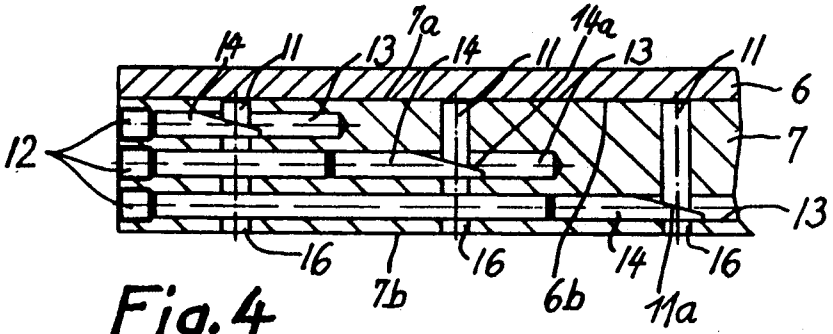
FIG. 4 is a fragmentary sectional view substantially as seen in the direction of arrows from the line IV—IV in FIG. 2.
Figure 3:
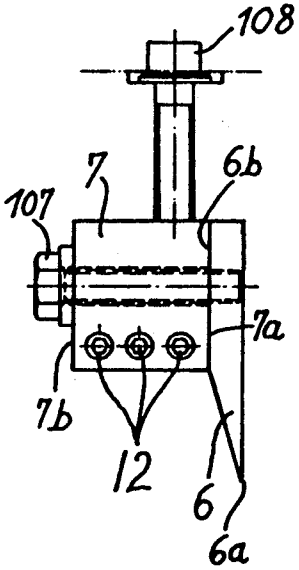
FIG. 3 is an end elevational view of the severing unit as shown in FIG. 2.

The details of one severing unit 3 are shown in FIGS. 2, 3 and 4. This unit comprises an elongated knife blade holder 7 having two end faces 17, 18 which are accessible when the holder 7 is mounted on the member 8 in close proximity to the holder or holders 7 of one or two neighboring severing units 3, and an elongated upright side face 7a which abuts the surface 6b of the blade 6. The cutting edge 6a of the blade 6 extends all the way between its end faces which may but need not be coplanar with the respective end faces 17, 18 of the holder 7.

The means for connecting the blade 6 to the holder 7 comprises a row of parallel externally threaded bolts 107 which are remote from the cutting edge 6a and extend at right angles to the planes of the surface 6b and side face 7a. The blade 6 is at least slightly flexible in the region between the shanks of the connecting bolts 107 and the cutting edge 6a, and the mechanism for adjusting the blade 6 and hence the cutting edge 6a relative to the corresponding counterknife 4 is installed in the holder 7 and includes moving elements in the form of externally threaded bolts 12 which are accessible at the two end faces 17 and 18. To this end, the holder 7 is provided with sets of parallel tapped bores or holes 13 which are parallel to the side face 7a and extend in substantial parallelism with the cutting edge 6a. The external threads of the moving elements or bolts 12 are in mesh with the internal threads of the holder 7, and the heads of the elements 12 are accessible at the respective end faces 17, 18 so that a screwdriver or another elementary tool can be employed to move the elements 12 axially and to thus change the axial positions of associated pin-shaped cylindrical displacing elements 11 which are recessed into the side face 7a of the holder 7 and engage the adjacent surface 6b of the blade 6 between the bolts 107 and the cutting edge 6a. The adjusting mechanism for the blade 6 further comprises wedge-shaped motion transmitting devices 14 which are reciprocable in the bores or holes 13 for the respective moving elements 12 and have surfaces 14a inclined relative to the side face 7a and abutting complementary surfaces 11a at the inner ends of the displacing elements 11. The elements 11 are reciprocable in bores or holes 16 which are machined into or are otherwise formed in the holder 7 and are normal to the side face 7a (and hence to the surface 6b when the blade 6 is properly connected to the holder by bolts 107). The moving elements 12, the displacing elements 11, and the motion transmitting devices 14 are disposed in a common horizontal plane which is normal to the side face 7a.

FIG. 2 shows that the blade 6 is adjustable by a set of six equidistant displacing elements 11. The bores or holes 16 for the three right-hand displacing elements 11 are provided in the right-hand half of the side face 7a, namely in that half which is adjacent the end face 18, and the bores or holes 16 for the other three displacing elements 11 are provided in the left-hand half of the side face 7a (i.e., in that half which is adjacent the end face 17). The number of bores or holes 16 in the one half of the side face 7a may but need not equal the number of holes or bores 16 in the other half of such side face. It is further possible to provide moving elements 12 only at one longitudinal end of the holder 7 if the number of displacing elements 11 is relatively small (i.e., if the blade 6 is relatively short) and/or if the end face 17 or 18 is not accessible when the respective severing unit 3 is assembled with one or more additional severing units 3 to form part of the apparatus 1.

The operation of the adjusting mechanism will be readily understood upon perusal of the preceding description. Thus, rotation of the moving elements 12 relative to the holder 7 in a direction to move the elements 12 deeper into the respective bores or holes 13 entails a corresponding movement of the associated wedge-like motion transmitting devices 14 whereby the inclined surfaces 14a of the devices 14 move relative to the adjacent surfaces 11a and move the elements 11 in the respective bores or holes 16 so that the corresponding portions of the cutting edge 6a are moved away from the side face 7a of the holder. If the moving elements 12 are rotated in the opposite direction, innate elasticity of the blade 6 causes the cutting edge 6a to move nearer to the side face 7a of the holder 7.

Each bore or hole 16 can extend all the way through the holder 7, i.e., from the side face 7a to the side face 7b (see FIG. 4).

An important advantage of the improved severing units 3 and of their adjusting mechanisms is that the heads of the moving elements 12 are accessible at the end faces 17 and 18 of the respective holders 7. Such end faces are normally accessible to the working ends of tools even if the severing units 3 are installed in immediate or close proximity to each other. Therefore, the positions of the cutting edges 6a relative to the associated holders 7 and counterknives 4 can be adjusted without necessitating even partial dismantling of the severing apparatus 1. Such adjustments can be carried out irrespective of the mutual spacing of neighboring severing units 3, i.e., such spacing can be selected exclusively in dependency on the desired width of strips or stacks of strips which are to be obtained in response to each lowering of the member 8. The latter is connected to the holders 6 by sets of bolts 108.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for severing sheet-like materials comprising at least one severing unit including a first knife and a second knife cooperable with said first knife to sever said materials; and means for moving one of said knives relative to the other of said knives, said first knife comprising a blade having an elongated cutting edge and a surface extending along and adjacent said cutting edge, a holder having an elongated side face adjacent said surface and at least one end face at one end of said side face, and means for adjusting said blade relative to said holder transversely of a plane containing said blade, said adjusting means comprising a plurality of displacing elements recessed into said side face and movable transversely of and against said surface, a moving element for each of said displacing elements, said moving elements being accessible at said at least one end face and being movable in said holder in substantial parallelism with said cutting edge, and means for transmitting motion from said moving elements to the respective displacing elements.

2. The apparatus of claim 1, wherein said one knife is said first knife and said second knife is a stationary counterknife.

3. The apparatus of claim 1, comprising at least one additional severing unit having a first knife and a second knife cooperable with said first knife to sever said materials, one knife of said at least one additional unit being connected to and being movable by said moving means.

4. The apparatus of claim 3, wherein said severing units are closely adjacent each other.

5. The apparatus of claim 4, wherein the cutting edge of the blade of the first knife of said at least one severing unit is parallel to the cutting edge of the blade of the one knife of said at least one additional severing unit.

6. The apparatus of claim 1, wherein said moving elements include pressure transmitting bolts having axes which are at least substantially parallel to said cutting edge.

7. The apparatus of claim 1, wherein said moving elements have external threads and said holder has tapped bores for said moving elements.

8. The apparatus of claim 1, wherein said holder has elongated first holes for said moving elements and the corresponding motion transmitting means, and second holes each communicating with one of said first holes, each of said second holes receiving one of said displacing elements and extending at least substantially transversely of said surface.

9. The apparatus of claim 8, wherein each of said motion transmitting means includes a wedge which is operative to move the respective displacing element in said second hole in response to movement of the corresponding moving element in said first hole.

10. The apparatus of claim 9, wherein each of said wedges has a surface which is inclined relative to the surface of said blade and each of said displacing elements has a surface complementary to and abutting the surface of the respective wedge.

11. The apparatus of claim 1, wherein said blade is at least slightly resilient.

12. The apparatus of claim 11, further comprising means for connecting said blade to said holder.

13. Apparatus for severing sheet-like materials comprising at least one severing unit including a first knife and a second knife cooperable with said first knife to sever said materials; and means for moving one of said knives relative to the other of said knives, said first knife comprising a blade having an elongated cutting edge and a surface extending along said cutting edge, a holder having an elongated side face adjacent said surface and at least one end face at one end of said side face, and means for adjusting said blade relative to said holder, said adjusting means comprising a plurality of displacing elements recessed into said side face and movable transversely of and against said surface, a moving element for each of said displacing elements, said moving elements being accessible at said at least one end face and being movable in said holder in substantial parallelism with said cutting edge, and means for transmitting motion from said moving elements to the respective displacing elements, said elements being disposed in a substantially common plane.

14. The apparatus of claim 13, wherein said plane is substantially horizontal.

15. Apparatus for severing sheet-like materials comprising at least one severing unit including a first knife and a second knife cooperable with said first knife to sever said materials; and means for moving one of said knives relative to the other of said knives, said first knife comprising a blade having an elongated cutting edge and a surface extending along said cutting edge, a holder having an elongated side face adjacent said surface, a first end face at one end and a second end face at the other end of said side face, and means for adjusting said blade relative to said holder, said adjusting means comprising a plurality of displacing elements recessed into said side face and movable transversely of and against said surface, a moving element for each of said displacing elements, said moving elements being accessible at said first end face and being movable in said holder in substantial parallelism with said cutting edge, means for transmitting motion from said moving elements to the respective displacing elements, at least one additional displacing element recessed into said side face and movable transversely of and against said surface at least one additional moving element which is accessible at said second end face and is movable in said holder in substantial parallelism with said cutting edge, and additional means for transmitting motion from said at least one additional moving element to said at least one additional displacing element.

16. The apparatus of claim 15, wherein said side face includes a first half adjacent said first end face and a second half adjacent said second end face, said at least one additional displacing element being recessed into said second half and said plurality of displacing elements which receive motion from said moving elements accessible at said first end face being recessed into the first half of said side face.

* * * * *